US006634610B1

(12) United States Patent
Ricci et al.

(10) Patent No.: US 6,634,610 B1
(45) Date of Patent: Oct. 21, 2003

(54) RETRACTABLE SELF-LEVELING CEILING SIGN HANGER

(75) Inventors: Annette Ricci, Lake Forest, IL (US); Heidi Grosowsky, Chicago, IL (US); Hiu-Yu Vanessa Chan, Chicago, IL (US); Michael Yurkovic, Park Ridge, IL (US)

(73) Assignee: Design & Deliver, Incorporated, Lake Forest, IL (US)

( * ) Notice: Subject to any disclaimer, the term of this patent is extended or adjusted under 35 U.S.C. 154(b) by 0 days.

(21) Appl. No.: 10/308,984

(22) Filed: Nov. 27, 2002

(51) Int. Cl.[7] ..... G09F 7/20

(52) U.S. Cl. ..... 248/330.1; 242/378; 242/380; 40/601; 40/617

(58) Field of Search ..... 248/328, 329, 248/330.1, 331, 332; 40/601, 617; 254/283; 242/378, 378.1, 380

(56) References Cited

U.S. PATENT DOCUMENTS 171,825 A * 1/1876 Lawton ..... 242/378
448,164 A * 3/1891 Reinmann ..... 191/12.2 R
1,332,383 A * 3/1920 Davis et al. ..... 242/378
4,434,570 A * 3/1984 Roos ..... 40/617
4,872,632 A * 10/1989 Johnson ..... 248/332
5,529,274 A * 6/1996 Anderson et al. ..... 248/329
5,870,845 A * 2/1999 Ruderman et al. ..... 40/601
6,161,702 A * 12/2000 Campbell ..... 211/17

* cited by examiner

*Primary Examiner*—Ramon O. Ramirez
*Assistant Examiner*—Jon Szumny
(74) *Attorney, Agent, or Firm*—Knechtel, Demeur & Samlan

(57) ABSTRACT

A self-leveling sign hanging device having a housing hung from the structural support members of suspended ceilings. A cable is stored in the housing on a wind up reel. A spring applies a force to the reel to wind the cable on the reel. The cable exits and returns to the housing forming a loop. At the bottom of the loop is a tubular bracket from which the sign is hung. The cable freely passes through the tubular bracket which allows the tubular bracket to remain horizontally level. Stops are mounted on the cable to restrict the length of cable wound onto the reel thus defining the height that the sign hangs above the floor.

19 Claims, 5 Drawing Sheets

RETRACTABLE SELF-LEVELING CEILING SIGN HANGER

BACKGROUND OF THE INVENTION

This invention relates to signs, posters or banners that are hung from ceilings. In particular this invention relates to retractable hanging mechanisms that are self-leveling.

There have been invented many hangers for hanging signs, advertising materials, or other materials from suspended ceilings. This is usually done by attaching a string or wire to a metal hanger that is attached to the cross bracing that supports the suspended ceiling. The sign is then attached to the other end of the string. This process requires the person hanging the sign to place a ladder under the area where the sign is to be hung, climb the ladder, to reach the suspended ceiling, and attach one end of the string to the ceiling brace. If a second string or wire is used, the process must be repeated. The appropriate length of string is let out and the other or loose end is attached to the sign. This process is repeated for the second string. Each time a new sign is hung, the strings may or may not be replaced, but the sign must be removed and a new sign attached to the loose ends of the string at the proper height. This presents a problem in that the exact amount of string must be measured from the ceiling for each string, or the sign will not be level.

There is also a safety issue when repeatedly moving a ladder into aisles where people may be present. Tools used to hang the sign may fall off the ladder injuring shoppers or employees. The installer may fall off the ladder when attaching the sign. The more times the installer has to climb the ladder, the greater the risk of injury. Thus it would be a great improvement over the prior art if the ceiling hung signs could be changed by a person while standing on the floor.

Various clips have been designed in the past that attach to ceiling members. One example is illustrated in U.S. Pat. No. 5,082,227 to Insko. This illustrates a hanger and tool that attaches to a suspended ceiling. The tool allows the hanger to be attached to the ceiling support members while the installer remains on the floor. However this device does not illustrate a self-leveling mechanism, nor does it provide a string or cable with which to attach the sign in a self-leveling arrangement.

SUMMARY OF THE INVENTION

In the preferred embodiment applicant's ceiling hanger has a hanger housing that attaches to an inverted T-shaped ceiling support beam by means of metal spring-loaded clips. Inside of the housing is a spring-loaded reel. One long cable of approximately twenty-four feet has one of its ends attached to the reel. The cable exits the housing and a spring-loaded stopper is threaded onto the cable. The cable passes through a hollow sign tube and a second spring loaded stopper is threaded onto the cable. The opposite end of the cable is attached to the reel. Both ends of the cable are wound on the reel so that when the cable is drawn off the reel, the spring applies a force to wind the cable back onto the reel. The sign is hung from the hollow tube. Each end of the cable is marked with different colored marks every foot, so that the spring-loaded stoppers can be placed to a colored mark on each end of the cable to set the sign hanging height. When the cable is wound back onto the reel, the spring-loaded stoppers engage the hanger housing, keeping the cables from further being wound upon the reel. The cable passes freely through the tube so that when the sign is hung from the tube, the weight of the tube and sign cause the sign and tube to self-level. A user extends a pole that has a molded pole head that engages the tube with either a pushing or grabbing side of the head depending on whether the user want to raise or lower the sign. To change the sign, the tube is pulled towards the ground and the cable unwinds from the reel. The user grasps the tube, changes the sign and/or the stoppers, and pushes the sign lightly with the pole. The weight of the sign and tube is released from the cable, and the cable retracts until the stoppers hit the hanger housing. In this manner the sign can be changed without the installer having to go up on a ladder.

OBJECT AND ADVANTAGES

An object of the self-leveling ceiling hanger is to provide a hanger to hang signs from a ceiling with a self-leveling mechanism so that the sign automatically levels itself with respect to the ground. Another object is to provide a ceiling hanger that easily attaches to suspended ceiling support members.

Another object is to provide a ceiling hanger that allows the installer to change the sign while standing on the ground once the hanger housing is attached to the ceiling supports. Related to this object is the object of providing a ceiling hanger that has a cable that extends from and retracts into the ceiling hanger housing by means of a spring-loaded reel. An advantage of this is that it allows the sign to be lowered to the ground by pulling on the sign to change the sign.

Another object is to provide a ceiling hanger that has stopping means on the cable to accurately measure the length of cable removed from the reel so that the sign is mounted the selected height above the floor.

Another object is to provide a ceiling hanger that is economical to manufacture and easy to operate.

These and other objects and advantages of the invention will become apparent to those skilled in the art when the following description of the drawings and detailed description of the preferred embodiment are studied.

DESCRIPTION OF THE PREFERRED EMBODIMENT

Figure 1:
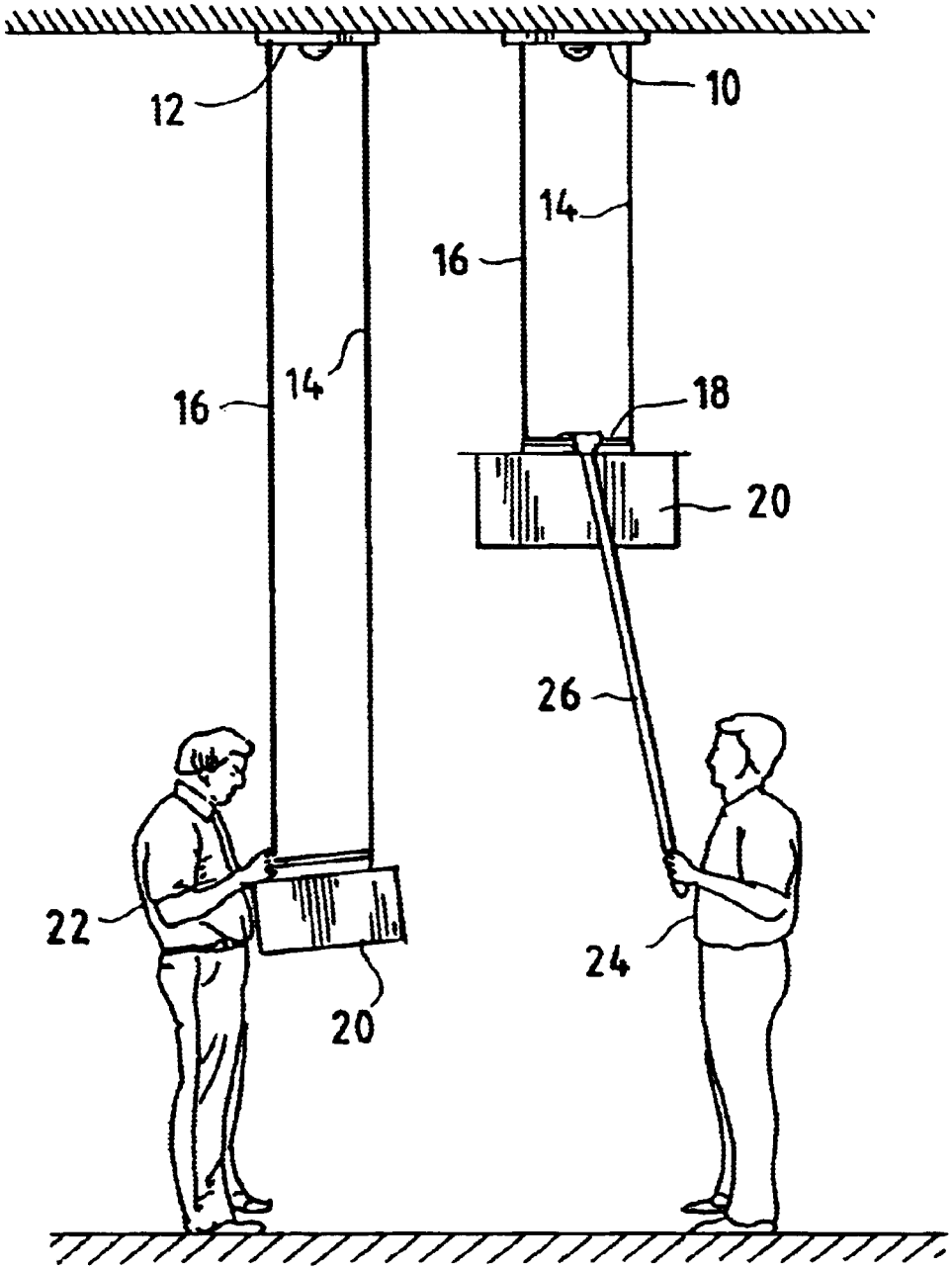
FIG. 1 is front view of ceiling hanger of the present invention in two positions, one in which the user is standing on the floor and attaching the sign; the other in which the user is pulling the sign down to be changed.

Turning to FIG. 1 there is illustrated a ceiling sign hanger 10 of the present invention. The ceiling sign hanger 10 has a housing 12 designed to be attached to a suspended ceiling. A cable 14 having left and right ends 15 and 16 respectively extends from the housing 12 to a sign hanging tube 18. Ideally the tube 18 is hollow and the cable 14 has its left end 15 threaded through the tube 18 and returns to the housing 12 by right end 16. The tube 18 is thus free to slide on the cable 14. A sign or banner 20 is hung from the tube 18. The cable 14 and left and right ends 15 and 16 form a loop extending from the housing 12. By varying the size of this loop, the distance that the sign 20 hangs above the floor can be adjusted. In one position a sign installer 22 is standing on the ground and holding the tube 18 and attaching the sign 20. In the other position the sign installer 24 is using a telescoping pole 26 to pull the tube 18 and the sign 20 hung from it toward the ground. Preferably the cable 14 is a single cable, but it may be made of two individual cables that are fastened together. The disadvantage is that in this embodiment, the cables may become undone.

Figure 2:
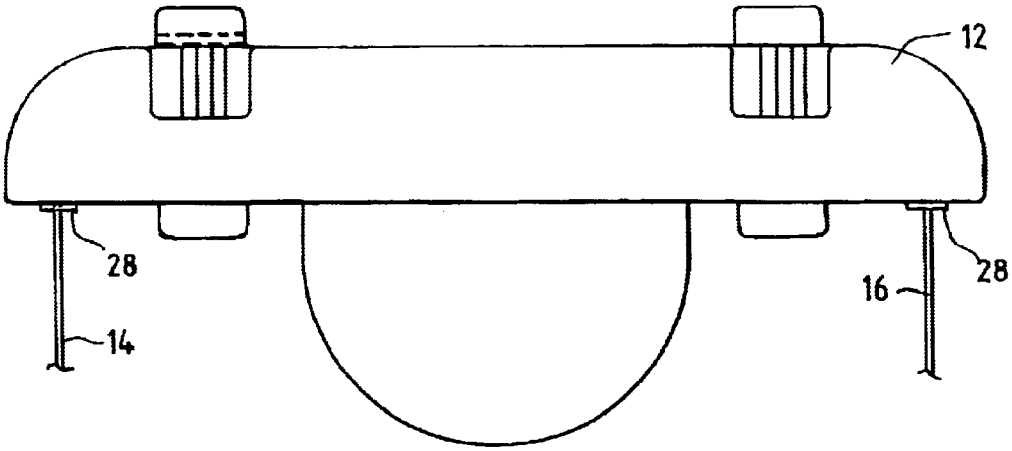
FIG. 2 is a front elevation view of the ceiling hanger housing.
Figure 3:
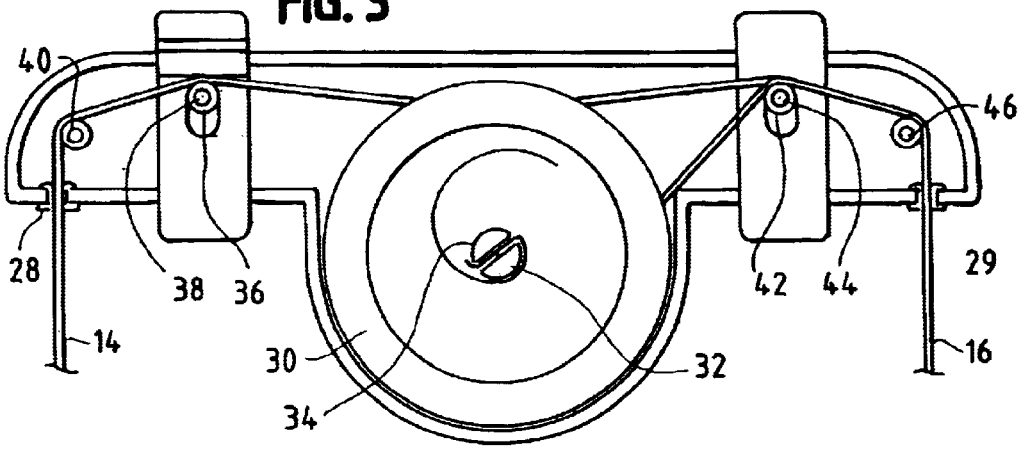
FIG. 3 is a front elevation view of the ceiling hanger housing with the cover removed exposing the internal components.
Figure 4:
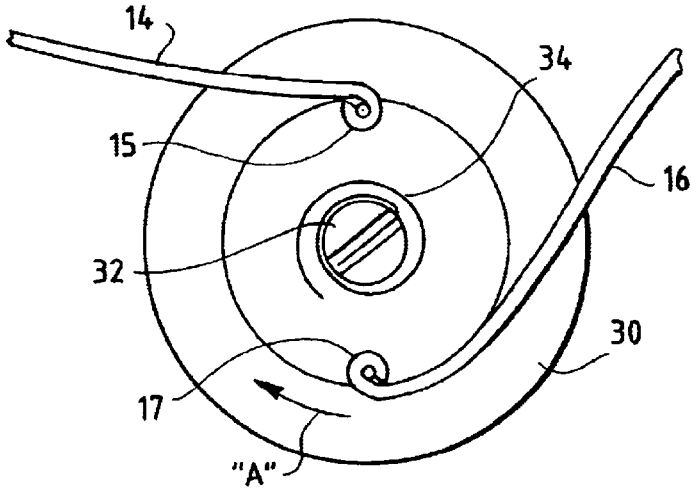
FIG. 4 is a front view with portions removed showing the internal construction of the spring-loaded take up reel.

As seen in FIG. 2 there are metal grommets 28 and 29 mounted on either side of the housing 12 where the cable end 15 and 16 pass through the housing 12. This minimizes the wear and tear on the cable ends 15 and 16 as they are pulled into and out from the housing 12. FIGS. 3 and 4 illustrate the internal operating components within the housing 12. There is a reel 30 mounted for rotation on a shaft 32. As seen in FIG. 4, the left and right ends 15 and 16 are attached to the reel 30. As the reel turns in the direction of arrow "A" the cable ends 15 and 16 simultaneously wind on the reel 30. A spring assembly 34 has one end connected to and is wrapped around the shaft 32. The other end of the spring assembly 34 is connected to the reel 30. The spring 34 applies a force to the reel 30 in the direction of arrow "A". Other types of spring assemblies can be used as long as a relatively constant force is applied to the reel 30 in one direction. The spring assembly 34 should apply a force to slowly raise a weight of about two pounds hanging from the cable 14. If greater sign weights are going to be hung, a stronger spring is required. The spring assembly 34 and reel 30 operate similar to a spring loaded tape measure that pulls the extended tape back into the housing after being pulled out to measure a distance.

From the reel 30, the left end 15 passes over a metal sleeve 36 on an idler roller 38. (See FIG. 3). The sleeve 36 rotates on the roller 38 to minimize cable wear. The left end 15 then passes over another idler roller 40, similar to the sleeve 36 and idler roller 38, before exiting through the metal grommet 28. From the reel 30, the right end 16 passes over a metal sleeve 42 on an idler roller 44. The right end 16 then passes over another idler roller 46, similar to the sleeve 42 and idler roller 44, before exiting the housing 12 through the grommet 29.

Figure 5:
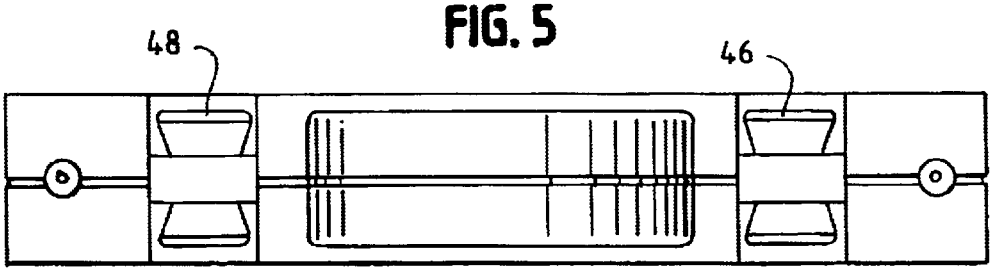
FIG. 5 is a bottom view of the ceiling hanger housing.
Figure 6:
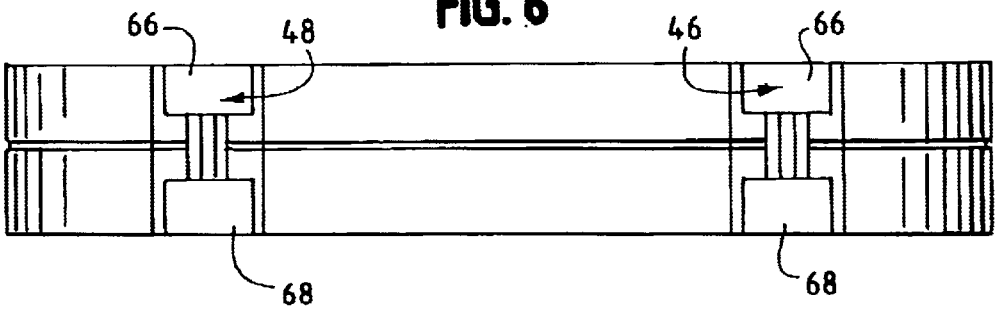
FIG. 6 is a top plan view of the ceiling hanger housing.
Figure 7:
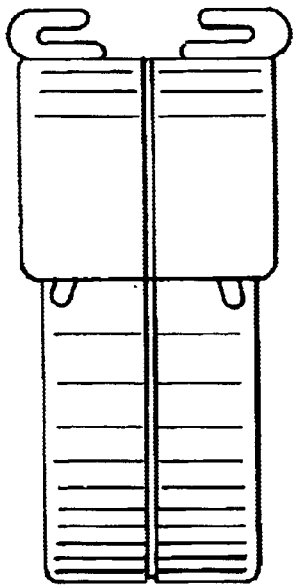
FIG. 7 is an end view of the ceiling hanger housing.
Figure 8:
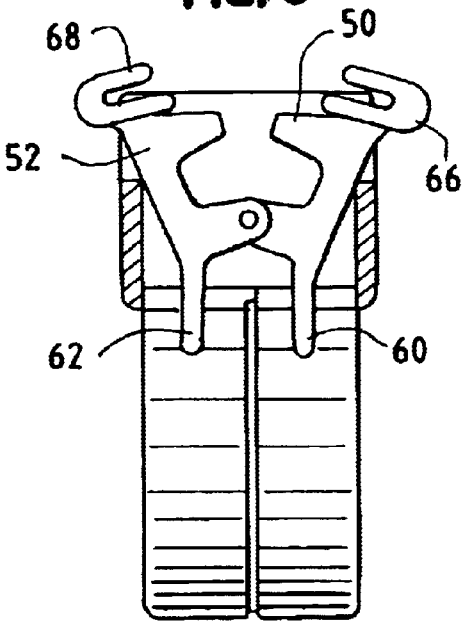
FIG. 8 is an end view of the ceiling hanger housing with portions removed illustrating the housing mounting clips in their open position.
Figure 9:
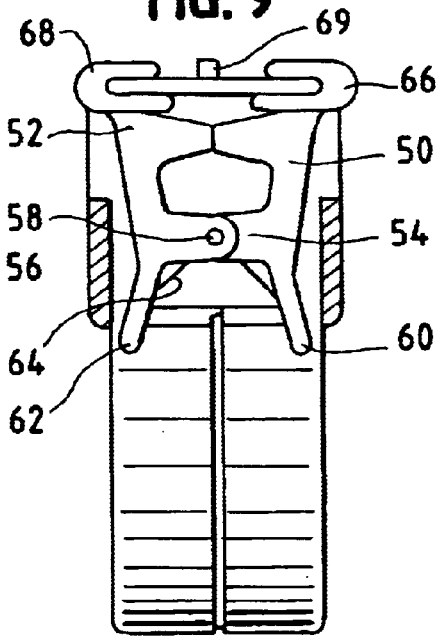
FIG. 9 is an end view of the ceiling hanger housing with portions illustrating the housing mounting clips in their closed position.

FIG. 5 is a bottom view of the housing 12. There is a pair of attachment clips 46 and 48, which are more clearly illustrated in FIGS. 8 and 9. The design of the clips 46 and 48 is similar to a clothespin. Each of the attachment clips is made from links 50, 52. Each link has an arm portion 54, 56 that is pivotally mounted on a common shaft 58. The links terminate at legs 60 and 62 which are adapted to be grasped by the thumb and index finger of the user. A spring 64 is wrapped around the shaft 58 and has its ends placed against the legs 60 and 62. The spring 64 applies a force against the legs 60 and 62 to force them apart. This causes head portions 66 and 68, which are opposite the legs 60, 62 to be forced toward each other with a force proportional to the spring force applied by the spring 64. When the user applies a compressive force to the legs 60, 62 to overcome the spring force applied by the spring 64, the head portions 66, 68 spread apart as seen in FIG. 8.

The head portions 66, 68 are c-shaped in cross section. They are designed to receive and lock onto a metal structural support 69 such as commonly used in suspended ceilings. When the metal support is positioned between the spread apart head portions 66, 68, the user releases pressure on the legs 60, 62 allowing the spring 62 to force the head portions 66, 68 back to their normally closed position with the metal support locked between the c-shaped portion of the heads 66, 68. The clips 46, 48 can be removed and repositioned by reversing the process and spreading the head portions 66, 68 away from each other to release the clips from the support.

The left and right cable ends 15 and 16 are marked with printed or painted bands or color coding 70, 72 at predetermined increments. These are most conveniently placed at one-foot increments as measured from either the housing 12 or from the ends of the cables 15 and 16. The pairs of markings 70, 72 should be approximately equal in distance from the ends of the cable 15 and 16. There is a spring loaded stopper 74 on both ends 15 and 16. The stopper 74 receives the cables 15 and 16 in a slidable relationship. There is a spring loaded stopper button 76 that passes through the stopper 74. When the stopper button 76 is pressed in, the stopper 74 is released from engaging the cable end 15 or 16 sot that it can be slid along and repositioned on the cable ends 15 or 16. When the stopper button 76 is released, the stopper 74 engages and locks onto the cable 15 or 16. The stoppers 74 are placed on the cable ends 15 and 16 with both stoppers 74 placed on a matching distance band 70, 72. When the cable ends 15 and 16 are pulled back into the housing 12, the stoppers 74 strike the housing 12 or depending on how far they extend from the housing, the metal grommets 28 and 29, which stops the further retraction of the cable ends 15 and 16 into the housing 12 and onto the reel 30. This controls the amount of cable that is wound onto the reel 30 and the amount of cable extending out from the reel 30. Although a spring loaded stopper 74 is disclosed, other stopper means can be employed such as a collar with a set screw or other similar device which operate in a similar manner. The advantage of a spring loaded stopper is that it can be released and positioned along the cable 14 without requiring additional tools.

Figure 10:
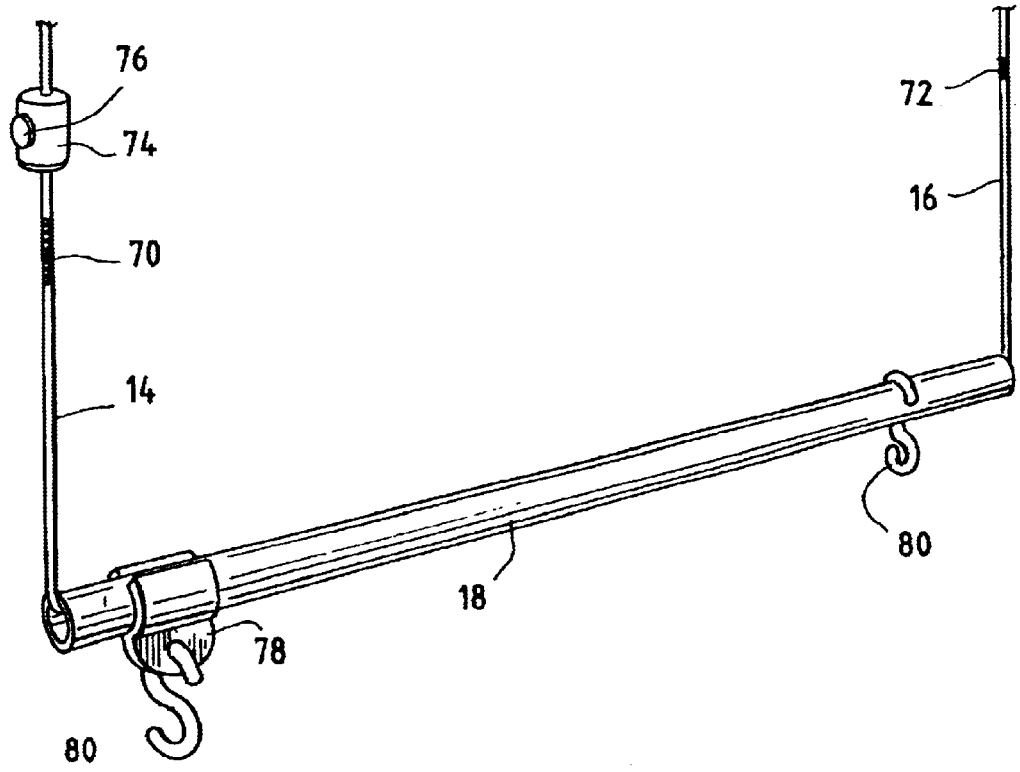
FIG. 10 is a perspective view of the sign hanging tube and sign hanging cable, with portions of the cable removed.

As seen in FIG. 10, as the left cable end 15 is threaded through the sign hanging tube 18 and exists the opposite end of the tube 18 as right cable end 16. As the tube 18 is hollow, the left and right cable ends 15 and 16 are free to slip through the tube 18. The tube 18 has an upside down T-bar 78 molded in one piece with the tube 18. Two "s" hooks 80 can be hung from holes 81 to which the sign 20 can be attached. Alternatively the T-bar 78 can be used with an open market banner hanging system. Other attachment means can be utilized that would be readily apparent to those skilled in the art.

Figure 11:
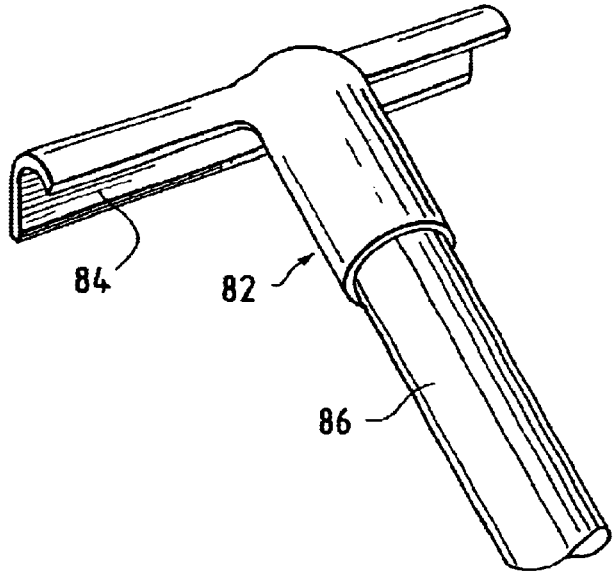
FIG. 11 is a front view with portions removed of the pole with molded head used to raise and lower the sign hanging tube.

To use the ceiling sign hanger 10, a tool 82 such as illustrated in FIG. 11 must be employed. The initial installation of the sign hanger 10 requires a ladder or other elevated support so that the housing 12 is mounted to the suspended ceiling metal support 69. The attachment clips 46 and 48 are clipped onto the support 69 at the location where the sign 20 is to hang. Once the housing is attached to the ceiling metal support 69, a ladder is no longer required to change the sign 20. The only reason a ladder is needed again is if the location of the sign is changed. The tool 82 is used to lower the tube 18 to attach or change a sign 20. The tool 82 has a head 84 at the end of the telescoping pole 26. The pole 26 is extended until the head 84 grasps the tube 18. The user pulls the tube down as seen in FIG. 1. The sign 20 is attached to the "s" clips 80. Other clips or mounting means can also be used to attach the sign 20 as will be apparent to those skilled in the art. The proper height that the sign is to hang from the ceiling is determined. The stoppers 74 are fastened to the left and right ends 15 and 16 at the place that allows the cable ends 15 and 16 to be withdrawn into the housing 12 so that the sign 20 hangs the proper height above the floor. The bands or marking 70, 72 along the left and right cable ends 15 and 16 make it easy to place the stoppers 74 at approximately the same distance from the ends 15 and 16. This also gives the installer an approximate location to place the stoppers 74 to hang the sign 20 at the desired height.

The installer 22 raises the sign 20 by using the tool 82 until the stoppers 74 engage the housing 12. The tool 82 is removed from engaging the tube 18 and the height of the sign is checked to verify that it is at the proper height. If it needs adjustment, the process is repeated and the stoppers 74 are moved along the left and right ends 15 and 16. As the ends 15 and 16 freely pass through the sign hanging tube 18, the weight of the sign and tube serve to self level the sign 20. This is the reason that the location of the stoppers 74 on the left and right ends 15 and 16 do not have to be exactly the same distance from the ends of the cable ends 15 and 16. The installer 22 merely slides the tube 18 along the cable 14 to assist in leveling the sign 20. No tools or further adjustments are necessary.

Figure 3A:
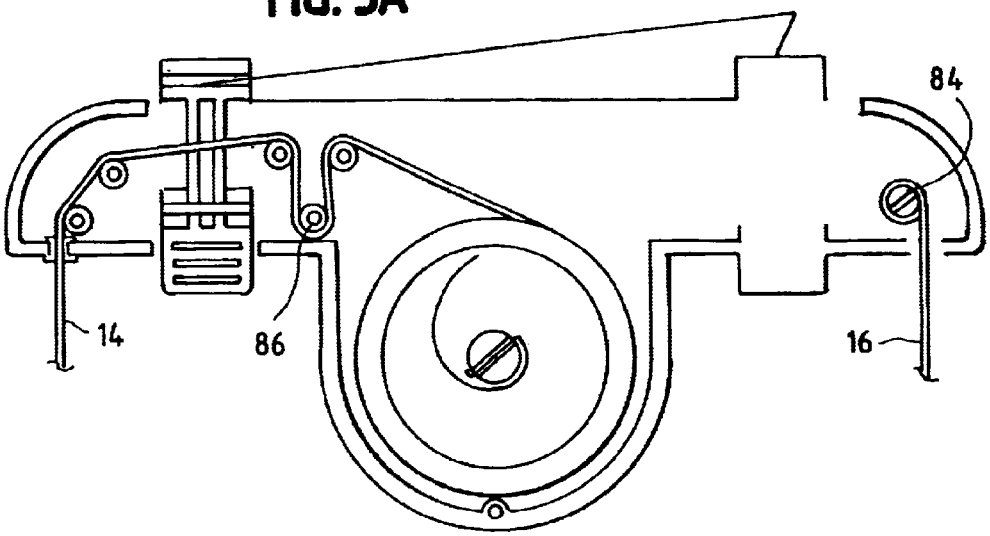
FIG. 3A is a front elevation view of an alternate embodiment of the ceiling hanger housing with the cover removed exposing the internal components.

FIG. 3A illustrates an alternate embodiment of the housing assembly with a different operating mechanism. The retracting mechanism is substantially similar to the previous embodiment except that only the left end 15 of the cable 14 is attached to the reel 30. The right end 16 of the cable 14 is attached to a screw 84 in the housing 12. The left end 15 passes over several idler rollers 86 as are necessary to supply adequate braking to the cable 15 as it is withdrawn onto the reel 30. Only a single stopper 74 is mounted on the left cable end 15 to control the amount of cable 14 that will wind on the reel 30. In operation, the stopper 74 is set at the desired height, the left cable end 15 withdraws into the housing 12 and the tube 18 slides along the cable 14 and levels itself along the bottom of the cable 14.

Thus there has been provided a self-leveling ceiling sign hanger that fully satisfies the objects and advantages as set forth above. The invention has been described in conjunction with specific embodiments; however, it is evident that other alternatives, modifications and variations will be apparent to those skilled in the art in light of the foregoing description. Accordingly it is intended to embrace all such alternatives, modifications and variations as fall within the spirit and scope of the appended claims.

What is claimed is:

1. A sign hanging device for hanging signs from a ceiling comprising:

a housing;

means for attaching the housing to the ceiling;

a cable stored within the housing and extending out from and returning to the housing thereby forming a loop;

cable retracting means mounted in the housing for retracting the extended cable into the housing, the cable retracting means comprising a reel and a spring means for applying a rotative force to the reel causing the reel to rotate and wind the cable on the reel;

stop means on the cable for stopping the cable retracting means from retracting the cable at a predetermined location thereby determining the length of cable extending out from the housing and the size of the loop;

a sign hanging bracket slidably mounted on the cable for horizontally leveling the sign; and means for hanging the sign from the sign hanging bracket;

whereby the spring means applies a rotative force to the reel sufficient to overcome the weight of the sign and the sign hanging bracket to raise the sign toward the ceiling until the stop means stops the cable from further retracting.

2. The sign hanging device of claim 1 wherein the stop means comprises a moveable stopping member that is releasably attached to the cable.

3. The sign hanging device of claim 2 wherein the stopping member engages the housing and stops the reel from rotating.

4. The sign hanging device of claim 3 wherein the stopping member comprises a stopper through which the cable passes and a spring loaded button that attaches the stopper to the cable.

5. The sign hanging device of claim 1 wherein the cable is comprised of two cables extending out from the housing, each of the two cables having a first end attached to the reel and each of the cables having a second end connected to each other.

6. The sign hanging device of claim 1 wherein the sign hanging bracket comprises a hollow tube through which the cable slidably passes.

7. The sign hanging device of claim 6 and further comprising hooks attached to the hollow tube from which the sign is hung.

8. The sign hanging device of claim 1 wherein the cable has two ends, one end connected to the reel and the other end connected to the housing.

9. The sign hanging device of claim 1 and further comprising indicia on the cable representing distances along the cable for attaching the stopping member at predetermined distances representing different loop sizes.

10. A sign hanging system for hanging signs from a ceiling comprising:

a housing;

means for attaching the housing to the ceiling;

a cable stored within the housing and extending out from and returning to the housing thereby forming a loop;

cable retracting means mounted in the housing for retracting the extended cable into the housing, the cable retracting means comprising a reel and a spring means for applying a rotative force to the reel causing the reel to rotate and wind the cable on the reel;

stop means on the cable for stopping the cable retracting means from retracting the cable at a predetermined location thereby determining the length of cable extending out from the housing and the size of the loop;

a sign hanging bracket slidably mounted on the cable for horizontally leveling the sign;

means for hanging the sign from the sign hanging bracket; and a pole with grasping means thereon for grasping the sign hanging bracket for pulling the bracket away from the housing by overcoming the spring's rotative force applied to the reel, and the spring means applies a rotative force to the reel sufficient to overcome the weight of the sign and the sign hanging bracket to raise the sign toward the ceiling until the stop means stops the cable from further retracting when the sign hanging bracket is released from the grasping means.

11. The sign hanging system of claim 10 wherein the stop means comprises a moveable stopping member that is releasably attached to the cable.

12. The sign hanging system of claim 11 wherein the stopping member engages the housing and stops the reel from rotating.

13. The sign hanging system of claim 12 wherein the stopping member comprises a stopper through which the cable passes and a spring loaded button that attaches the stopper to the cable.

14. The sign hanging system of claim 10 wherein the cable is comprised of two cables extending out from the housing, each of the two cables having a first end attached to the reel and each of the cables having a second end connected to each other.

15. The sign hanging system of claim 10 wherein the sign hanging bracket comprises a hollow tube through which the cable slidably passes.

16. The sign hanging system of claim 15 and further comprising hooks attached to the hollow tube from which the sign is hung.

17. The sign hanging system of claim 10 wherein the cable has two ends, one end connected to the reel and the other end connected to the housing.

18. The sign hanging system of claim 10 and further comprising indicia on the cable representing distances along the cable for attaching the stopping member at predetermined distances representing different loop sizes.

19. A method for hanging signs from a ceiling comprising the steps of:

providing a housing attached to a ceiling support member;

storing a cable on a reel within the housing;

withdrawing the cable from the housing and returning the cable to the housing thereby forming a loop;

providing cable retracting means mounted in the housing for retracting the extended cable back into the housing, the cable retracting means comprising a reel and a spring means;

applying a rotative force by the spring means causing the reel to rotate and wind the cable on the reel;

attaching stop means on the cable for stopping the cable retracting means from retracting the cable at a predetermined location thereby determining the length of cable extending out from the housing and the size of the loop;

slidably mounting a sign hanging bracket on the cable for horizontally leveling the sign;

hanging the sign from the sign hanging bracket;

the spring means applying a rotative force to the reel sufficient to overcome the weight of the sign and the sign hanging bracket raising the sign toward the ceiling until the stop means stops the cable from further retracting.

* * * * *